US005674666A

United States Patent [19]

Lau et al.

[11] Patent Number: 5,674,666

[45] Date of Patent: Oct. 7, 1997

[54] PHOTOGRAPHIC ELEMENTS CONTAINING NEW CYAN DYE-FORMING COUPLER PROVIDING IMPROVED COLOR REPRODUCTION

[75] Inventors: Philip T. Lau; Louis J. Rossi; Stanley W. Cowan, all of Rochester, N.Y.

[73] Assignee: Eastman Kodak Company, Rochester, N.Y.

[21] Appl. No.: 742,784

[22] Filed: Oct. 31, 1996

[51] Int. Cl.[6] ..... G03C 7/34

[52] U.S. Cl. ..... 430/384; 430/385; 430/546; 430/552; 430/553

[58] Field of Search ..... 430/552, 553, 430/546, 384, 385

[56] References Cited

U.S. PATENT DOCUMENTS

| | | | |
|---|---|---|---|
| 3,041,236 | 6/1962 | Stecker | 430/553 |
| 5,008,180 | 4/1991 | Merkel et al. | 430/552 |
| 5,399,467 | 3/1995 | Krishnamurthy et al. | 430/552 |

FOREIGN PATENT DOCUMENTS

| | | | |
|---|---|---|---|
| 754306 | 8/1956 | United Kingdom | 430/553 |

*Primary Examiner*—Lee C. Wright
*Attorney, Agent, or Firm*—Arthur E. Kluegel

[57] ABSTRACT

The invention provides a photographic element which comprises a light-sensitive silver halide emulsion layer having associated therewith a cyan dye-forming coupler having the formula:

wherein:

$R_1$ represents an alkyl or aryl group;

$R_2$ represents an alkyl group of 2 to 4 carbon atoms;

Ar represents an aryl group; and

Z represents a hydrogen atom or a group capable of being split off by reaction of the coupler with an oxidized color developing agent.

Such elements provide an improved cyan dye hue upon development.

17 Claims, No Drawings

PHOTOGRAPHIC ELEMENTS CONTAINING NEW CYAN DYE-FORMING COUPLER PROVIDING IMPROVED COLOR REPRODUCTION

FIELD OF THE INVENTION

The present invention relates to a photographic silver halide material containing a particular cyan dye forming coupler with improved dye hue.

BACKGROUND OF THE INVENTION

A typical color photographic element contains multiple layers of light-sensitive photographic silver halide emulsions with one or more of these layers being spectrally sensitized to each of blue light, green light and red light. The blue, green and red light-sensitive layers are typically associated with yellow, magenta, and cyan dye-forming couplers, respectively.

To form a color photographic image, the color photographic material is exposed imagewise and processed in a color developer bath containing an aromatic primary amine color developing agent, typically a p-phenylenediamine. Image dyes are formed by the coupling reaction of these couplers with the oxidized product of the color developing agent.

Generally, image couplers are selected according to their ability to couple efficiently with oxidized color developer, thus minimizing the necessary amounts of coupler and silver halide emulsion in the photographic element; to provide image dyes whose hues are appropriate for the particular photographic application in which they are to be used; to provide image dyes whose absorption spectra have low unwanted side absorptions and thus lead to good color reproduction; to provide image dyes with good stability to heat, light, and ferrous ions which are present in the bleaching solution; and to provide good physical and chemical properties such as good solubility in coupler solvents, and good dispersibility in gelatin.

In recent years, a great deal of study has been conducted to improve dye-forming couplers for silver halide photosensitive materials in terms of improved color reproducibility and image dye stability. However, an entirely satisfactory improvement has not been made, particularly in the area of cyan couplers.

The couplers used to form cyan image dyes are generally derived from naphthols and phenols, as described, for example, in U.S Pat. Nos. 2,367,351, 2,423,730, 2,474,293, 2,772,161, 2,772,162, 2,895,826, 2,920,961, 3,002,836, 3,466,622, 3,476,563, 3,552,962, 3,758,308, 3,779,763, 3,839,044, 3,880,661, 3,998,642, 4,333,999, 4,990,436, 4,960,685, and 5,476,757; in French patents 1,478,188 and 1,479,043; and in British patent 2,070,000. These types of couplers can be used either by being incorporated in the photographic silver halide emulsion layers or externally in the processing baths. In the former case the couplers must have ballast substituents built into the molecule to prevent the couplers from migrating from one layer into another. Although these couplers have been used extensively in color photographic film and paper products, the image dyes derived from them generally have broad absorption spectra with excessive green absorption on the short wavelength side, resulting in considerable reduction in color reproduction and color saturation.

Cyan couplers which have been proposed to overcome this problem are nitrogen-containing heterocyclic couplers as disclosed in U.S. Pat. Nos. 4,728,598, 4,818,672, 4,873,183, 4,916,051, 5,118,812, and 5,205,129, and European Patent No. 249,453A. Even though cyan dyes produced by these couplers show a reduction in their undesirable side absorptions, these couplers exhibit undesirably low coupling activity. Furthermore, the dyes derived from them have very low stability against heat and light, and their absorption spectra peak at very short wavelengths. These disclosed couplers are therefore not practical for use in photographic products.

Other cyan couplers proposed for improving color reproduction are disclosed in U.S. Pat. Nos. 3,551,962, 3,839,044, and 4,960,685, and German patent publications DE 3,005,355 and 3,022,915. All of these couplers are based on a well-known coupler parent disclosed in U.S. Pat. No. 3,022,836 that is currently used in color film systems in which the coupler is dissolved in the color developer solution (See formula I). However, to use these couplers as incorporated couplers in the silver halide emulsion layers, and to achieve the same desirable dye hue as provided by the coupler represented by formula (I), these couplers must by necessity be ballasted or anchored to a suitable polymeric backbone through the aryloxy coupling-off groups as illustrated by formula (II).

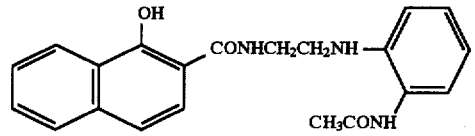

(I)

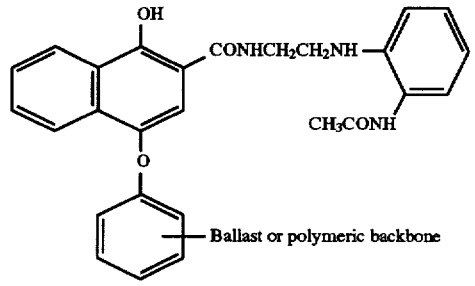

(II)

While these latter couplers form the same dye as those provided by formula (I), their color reproducibility is highly variable and dependent on the type and nature of the coupling-off groups, which because of the ballasts, are not readily washed out of the photographic layers during processing.

U.S. Pat. No. 5,183,729 discloses a class of 2-arylureido-5-acylaminophenol couplers useful for forming dyes that absorb around 630–645 nm. While these couplers form dyes with good absorption characteristics, they have been found to suffer from severe thermal yellowing, that is, formation of a yellow stain during storage of the processed photographs, thus making them unsuitable for use in photographic products.

It is a problem to be solved to provide a photographic element containing a cyan coupler that forms a dye of improved hue.

SUMMARY OF THE INVENTION

The invention provides a photographic element which comprises a light-sensitive silver halide emulsion layer having associated therewith a cyan dye-forming coupler having the formula:

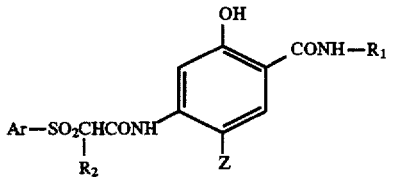

wherein:

$R_1$ represents an alkyl or aryl group;

$R_2$ represents an alkyl group of 2 to 4 carbon atoms;

Ar represents an aryl group; and

Z represents a hydrogen atom or a group capable of being split off by reaction of the coupler with an oxidized color developing agent.

The invention also provides a coupler compound, a dye formed by the compound, an emulsion layer containing the coupler, and a method of forming an image in an element of the invention.

DETAILED DESCRIPTION OF THE INVENTION

The coupler of the invention is generally as described in the Summary of the Invention. These couplers yield cyan dyes of improved hue whose absorption spectra are very sharp-cutting on the short wavelength side and whose absorption maxima (λmax) are generally in the range of 640–680 nanometers.

In the formula, $R_1$ represents an alkyl group (linear or branched, saturated or unsaturated) having preferably 1 to 20 carbon atoms, more preferably 1 to 4 carbon atoms, such as methyl, propyl or dodecyl; a perfluoroalkyl group such as trifluoromethyl or perfluorotetradecyl, heptafluoropropyl or heptadecafluorooctyl; an aryl group having preferably 6 to 30 carbon atoms which may optionally be substituted by one or more independently chosen substituent groups preferably selected from halogen, cyano, carbonyl, carbonamido, sulfonamido, carboxy, sulfo, alkyl, aryl, alkoxy, aryloxy, alkylthio, arylthio, an alkylsulfonyl and an arylsulfonyl group. More particularly, $R_1$ may represent a heptafluoropropyl group, a phenyl group, a 4-chlorophenyl group, a 3,4-dichlorophenyl group, a 4-cyanophenyl group, a 3-chloro-4-cyanophenyl group, a pentafluorophenyl group, a 4-carbonamidophenyl group, a 4-sulfonamidophenyl group, or an alkylsulfonylphenyl group.

In the formula, $R_2$ represents a linear or branched alkyl group of 2 to 4 carbon atoms, preferably an ethyl group.

In the formula, Ar suitably represents a phenyl group preferably bearing one or more substituents, each of which may be independently selected as defined for substituents herein. Examples are a linear or branched, saturated or unsaturated alkyl group such as methyl, t-butyl, dodecyl, pentadecyl or octadecyl; an alkoxy group such as methoxy, t-butoxy or tetradecyloxy; a substituted or unsubstituted aryloxy group such as phenoxy, 4-t-butylphenoxy or 4-dodecylphenoxy; an alkyl or aryl acyloxy group such as acetoxy or dodecanoyloxy; an alkyl or aryl acylamino group such as acetamido, benzamido, or hexadecanamido; an alkyl or aryl sulfonyloxy group such as methylsulfonyloxy, dodecylsulfonyloxy, or 4-methylphenylsulfonyloxy; an alkyl or aryl sulfamoylamino group such as N-butylsulfamoylamino, or N-4-t-butylphenylsulfamoylamino; an alkyl or aryl sulfonamido group such as methanesulfonamido, 4-chlorophenylsulfonamido or hexadecanesulfonamido; a ureido group such as methylureido or phenylureido; an alkoxycarbonyl or aryloxycarbonylamino group such as methoxycarbonylamino or phenoxycarbonylamo; a carbamoyl group such as N-butylcarbamoyl or N-methyl-N-dodecylcarbamoyl; or a perfluoroalkyl group such as trifluoromethyl or heptafluoropropyl. More preferably, the phenyl group is substituted by one or more alkyl groups, and most preferably, the phenyl group is substituted at the meta or para position by an alkyl group having 12–18 carbon atoms.

In the formula, Z represents a hydrogen atom or a group which can be split off by the reaction of the coupler with an oxidized color developing agent, known in the art as a "coupling-off group." Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

The presence of hydrogen at the coupling site (the site on the coupler molecule at which Z is attached) provides a 4-equivalent coupler, and the presence of a coupling-off group other than hydrogen usually provides a 2-equivalent coupler. Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio, and arylazo. These coupling-off groups are described in the art, for example, in U.S. Pat. Nos. 2,455,169, 3,227,551, 3,432,521, 3,467,563, 3,617,291, 3,880,661, 4,052,212, and 4,134,766; and in U. K. Patents and published applications 1,466,728, 1,531,927, 1,533,039, 2,066,755A, and 2,017,704A, the disclosures of which are incorporated herein by reference. Halogen, alkoxy and aryloxy groups are most suitable.

It is essential that the substituent groups $R_1$, $R_2$, Ar, and Z be selected so as to adequately ballast the coupler and the resulting dye in the organic solvent in which the coupler is dispersed. The ballasting may be accomplished by providing hydrophobic substituent groups in one or more of the substituent groups $R_1$, $R_2$, Ar, and Z. Generally a ballast group is an organic radical of such size and configuration as to confer on the coupler molecule sufficient bulk and aqueous insolubility as to render the coupler substantially non-dfffusible from the layer in which it is coated in a photographic element. Thus the combination of substituent groups $R_1$, $R_2$, Ar, and Z in the formula are suitably chosen to meet these criteria. To be effective, the ballast typically contains 10 to 30 carbon atoms, and may be suitably located in substituent $R_1$, $R_2$, Ar, and Z. Suitable ballasting may also be accomplished by providing a plurality of groups which in combination meet these criteria. Furthermore, even if the coupling-off group Z contains a ballast it is often necessary to ballast the other substituents as well, since Z is eliminated from the molecule upon coupling; thus, the ballast is most advantageously provided as part of groups $R_1$, $R_2$ and Ar.

The couplers of the invention may be dispersed with the use of any suitable coupler solvent; however, the best hues are generally achieved with solvents of the aliphatic alcohol type, such as oleyl alcohol. These solvents are therefore preferred.

The following examples further illustrate the invention. It is not to be construed that the present invention is limited to these examples.

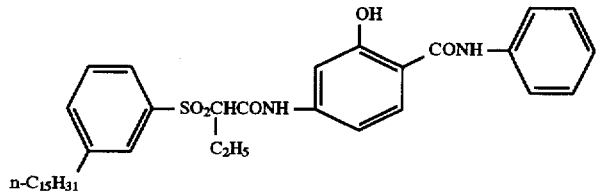
I-1
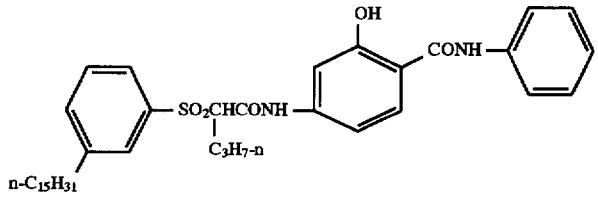
I-2
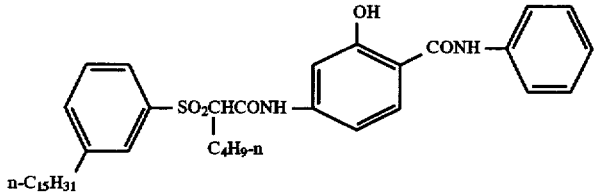
I-3
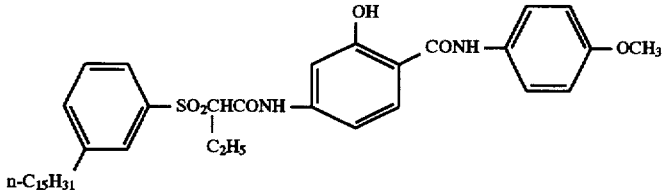
I-4
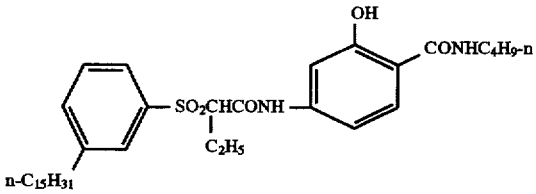
I-5
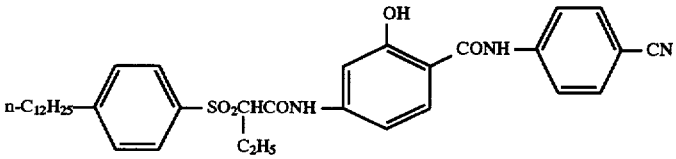
I-6
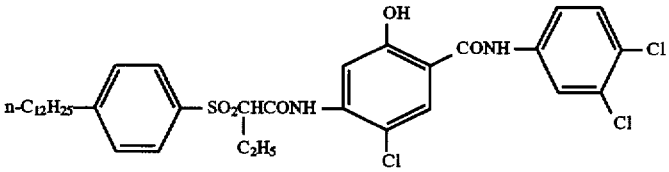
I-7
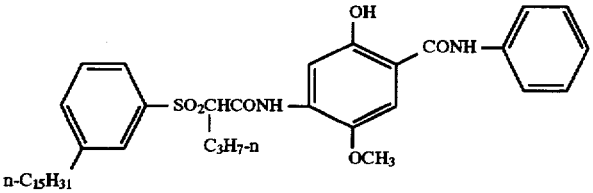
I-8

-continued
I-9
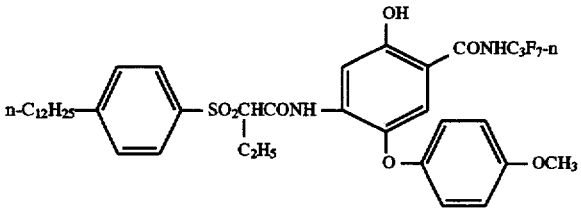
I-10
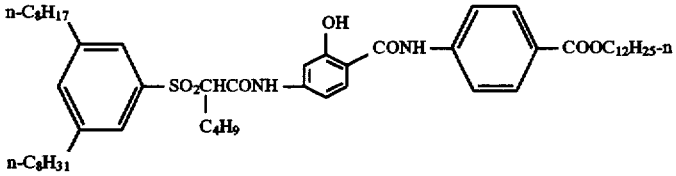
I-11
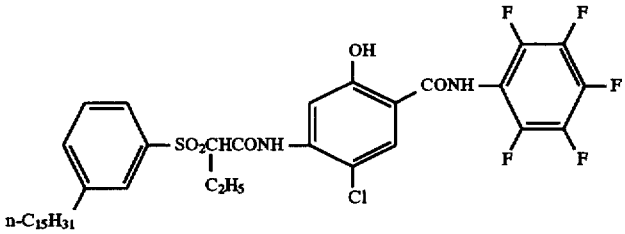
I-12
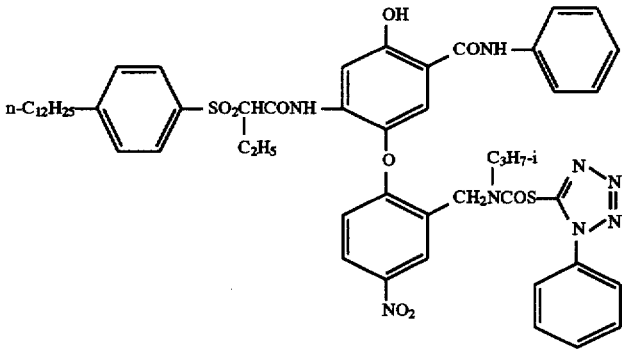
I-13
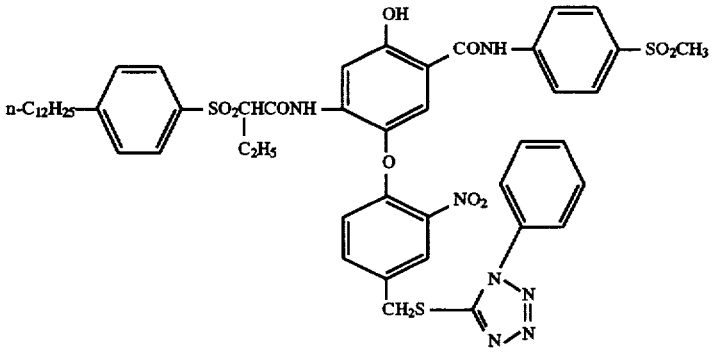
I-14
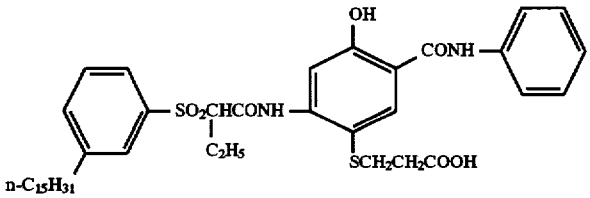

-continued

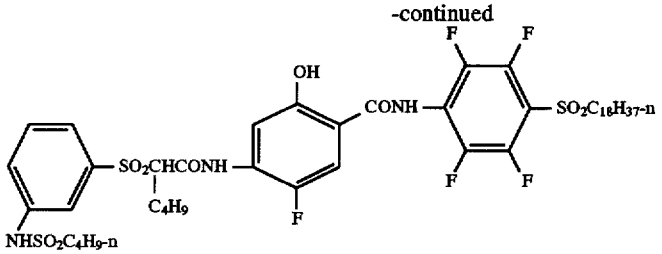

I-15

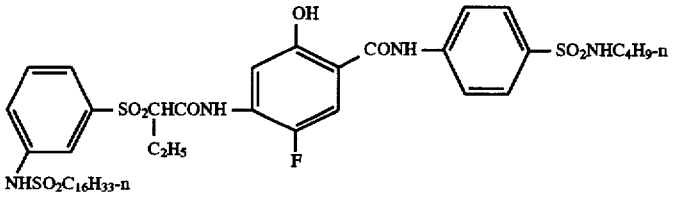

I-16

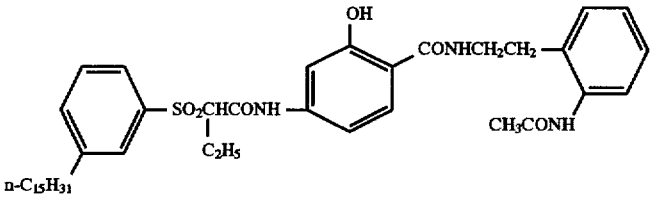

I-17

Unless otherwise specifically stated, subsfituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbanoyl, N,N-dibutylcarbamoyl, N-octadecylcarbamoyl, N-[4-(2,4-di-t-pentylphenoxy)butyl]carbarmoyl, N-methyl-N-tetradecylcarbarmoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in non-invention coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art and are discussed earlier with respect to the invention. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,475,563, 3,617,291, 3,880,651, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 95,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

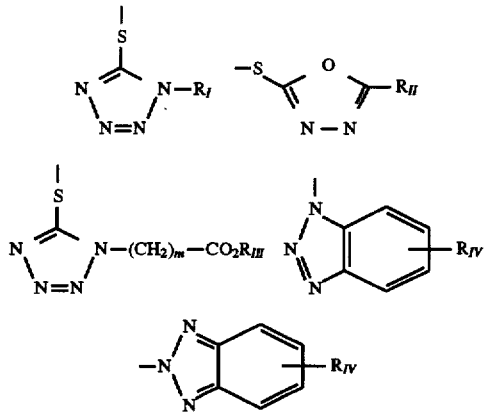

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

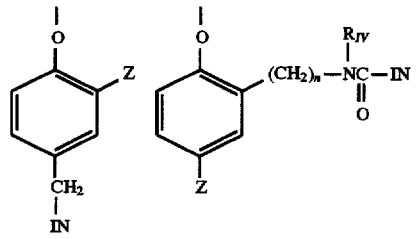

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

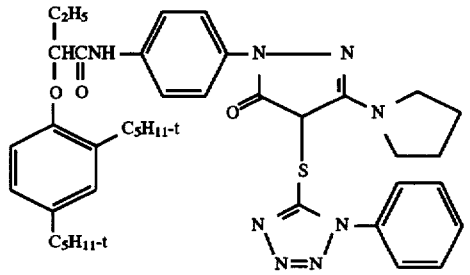

D1

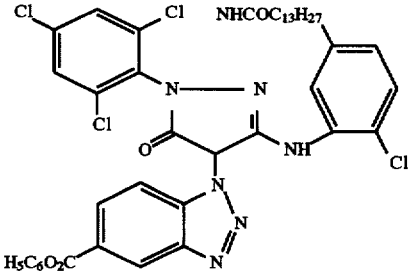

D2

-continued
D3
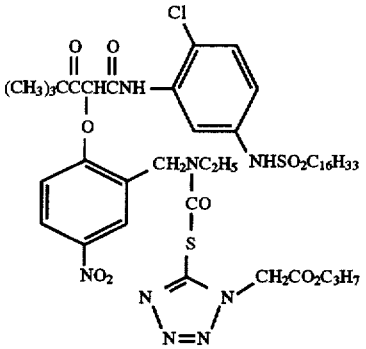
D4
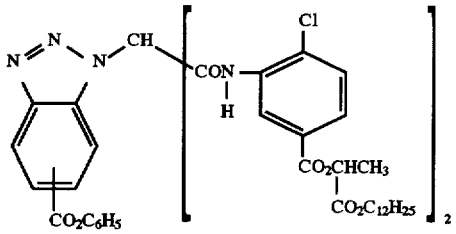
D5
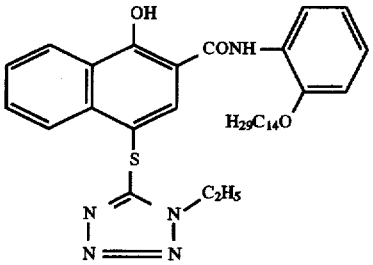
D6
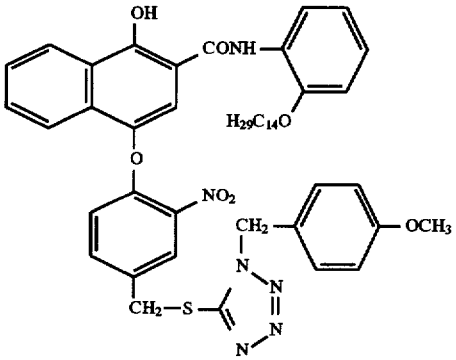
D7
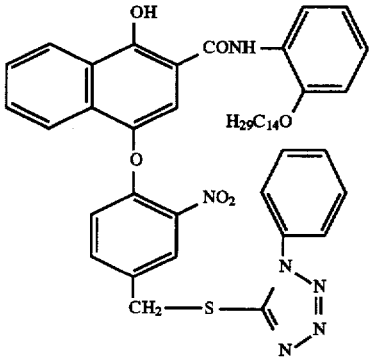
-continued
D8
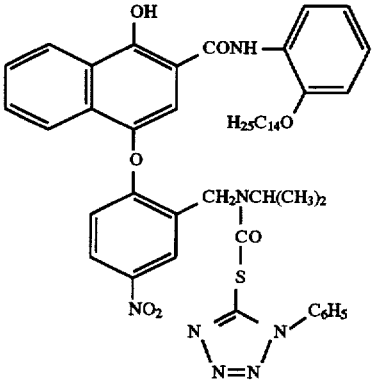
D9
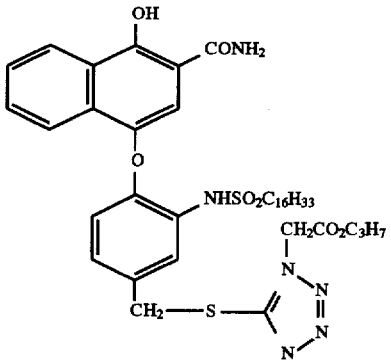
D10
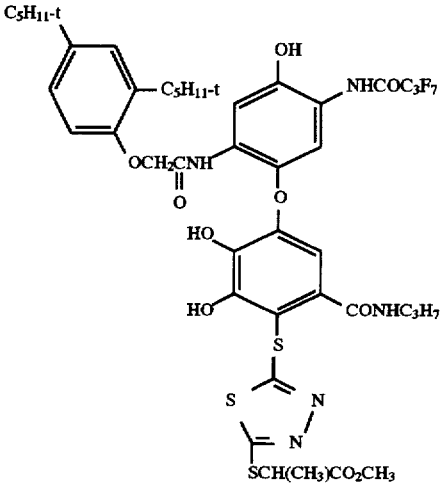
D11
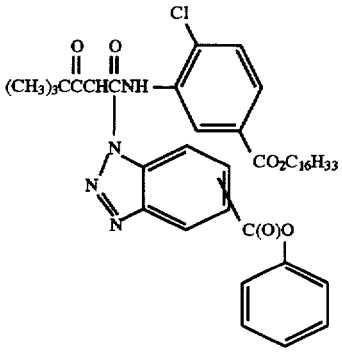

-continued

D12

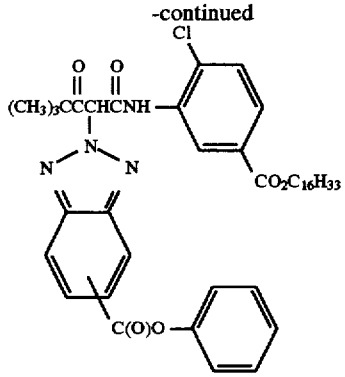

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element is designed for image capture and speed (the sensitivity of the element to low light conditions) is often critical to obtaining sufficient image in such elements. When such elements are to be used to generate a color print, they are typically processed in known color negative processes such as the Kodak C-41 process as described in The British Journal of Photography Annual of 1988, pages 191–198. If such an element is to be employed to generate a viewable projection print as for a motion picture, a process such as the Kodak ECN-2 process described in the H-24 Manual available from Eastman Kodak Co. may be employed. Color negative development times are typically 3'15" or less and preferably 90 or even 60 seconds or less.

Color reflection prints may be processed, for example, using the Kodak RA-4 process as described in The British Journal of Photography Annual of 1988, Pp 198–199; color projection prints may be processed, for example, in accordance with the Kodak ECP-2 process as described in the H-24 Manual. Color print development times are typically 90 seconds or less and preferably 45 or even 30 seconds or less.

To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned Kodak C-41, Kodak RA-4, or Kodak E-6 process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various patent applications, patents and other publications referred to in this specification are incorporated herein by reference.

SYNTHESIS EXAMPLE

The cyan couplers of this invention can be prepared by reacting an alkyl or aryl amine with an appropriately substituted phenol such as phenyl 5-nitro-salicylate to form the 2-phenylcarbamyl-5-nitrophenol. The nitro group can then be reduced and reacted with the sulfone-containing acid chloride ballast to give the cyan coupler. The synthesis of cyan coupler I-1 will further illustrate the synthetic procedure.

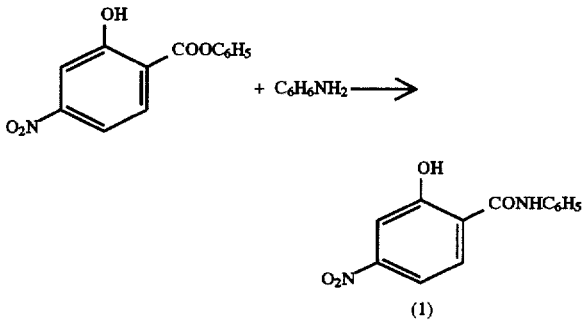

-continued

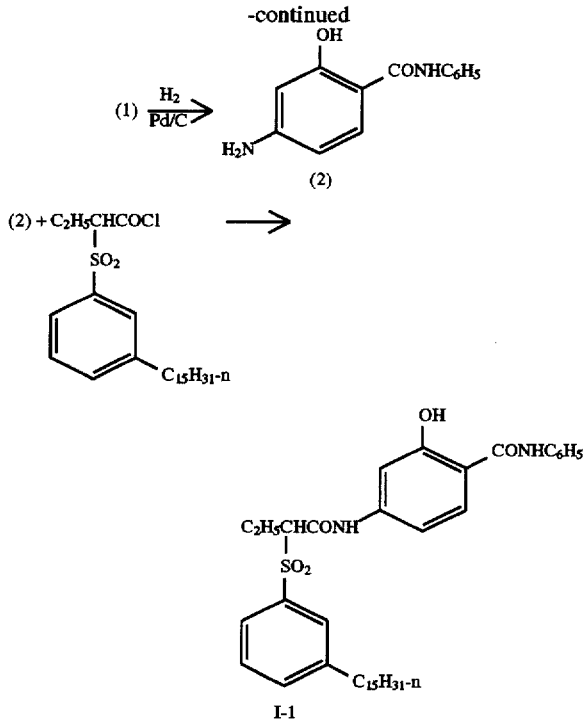

Synthesis of Intermediate (1)

Phenyl 5-nitrosalicylate (20.7 g, 0.080 mole) was suspended in 15 ml aniline and heated at 200° C. with stirring for one hour, at which time TLC. showed that all of the phenyl ester was consumed. The melt solidified after cooling. It was triturated with 80 ml methanol, collected to give 19.5 g (1 ), m.p. 246° C.; MS (I-H, 257).

Synthesis of Intermediate (2)

A suspension of 19.0 g (0.0736 mole) of (1 ) and 1 g 10% Pd/C in 150 ml THF was hydrogenated in a Parr apparatus. After 30 minutes hydrogenation was complete. The catalyst was removed by filtration through celite and the solvent was removed under reduced pressure to give 16.9 g (2 ), m.p. 146°–149° C.; MS (I-H, 227).

Synthesis of Coupler I-1

A suspension of (2 ) (4.56 g, 0.020 mole) and 4.85 g (0.0402 mole) N,N-dimethylaniline in 100 ml THF was treated at ambient temperature with 9.6 g (0.021 mole) alpha-(3-n-pentadecylphenylsulfonyl)butyryl chloride dissolved in 6.0 ml THF and 5 drops DMF. The mixture was stirred for 3 hours during which time a solution resulted. The amber solution was poured onto 250 g ice and 25 ml 6N HCl. Extraction with ethyl acetate, drying with $MgSO_4$ and removal of solvent gave an amber oil which crystallized with 50 ml methanol to give 11.1 g crude product. Recrystallization from alcohol gave 7.95 g (61.5%) white crystalline solid, m.p. 158°–159° C.

Calcd. for $C_{38}H_{52}N_2O_5S$: C, 70.34; H, 8.08; N, 4.32, S, 4.04 Found: C, 70.52, H, 7.82, N, 4.31, S, 4.91 MS (M-H, 647)

Preparation of Photographic Elements

On a gel-subbed, polyethylene-coated paper support were coated the following layers:

First Layer

An underlayer containing 3.23 grams gelatin per square meter.

Second Layer

A photosensitive layer containing (per square meter) 2.15 grams gelatin, an amount of red-sensitized silver chloride emulsion containing 0.39 g silver; a dispersion containing $8.61\times10^{-4}$ mole of the coupler indicated in Table 1; and 0.043 gram surfactant Alkanol XC (trademark of E. I. Dupont Co.)(in addition to the Alkanol XC used to prepare the coupler dispersion). The coupler dispersion contained the coupler, all of the gelatin in the layer except that supplied by the emulsion, an amount of the coupler solvent indicated in Table 1 equal to the weight of coupler, and 0.22 gram Alkanol XC.

Third Layer

A protective layer containing (per square meter) 1.40 grams gelatin, 0.15 gram bis(vinylsulfonyl)methane, 0.043 gram Alkanol XC, and $4.40\times10^{-6}$ gram tetraethylammonium perfluorooctanesulfonate.

The coupler solvents used were dibutyl phthalate (S-1) and oleyl alcohol (S-2).

The comparison coupler used was:

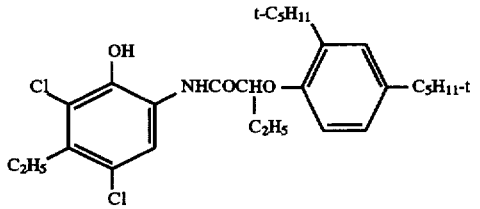

C-1

Comparison coupler C-1 is a phenolic coupler used in many commercially available color photographic papers.

Preparation of Processed Photographic Examples

Processed samples were prepared by exposing the coatings through a step wedge and processing as follows:

| Process Step | Time (min.) | Temp (°C.) |
|---|---|---|
| Developer | 0.75 | 35.0 |
| Bleach-Fix | 0.75 | 35.0 |
| Water-wash | 1.50 | 35.0 |

The processing solutions used in the above process had the following compositions (amounts per liter of solution):

| Developer | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing agent Dev-1 | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7° C. | |
| **Bleach-Fix** | |
| Solution of ammonium thiosulfate | 71.85 g |
| Ammonium sulfite | 5.10 g |

-continued

| | |
|---|---|
| Sodium metabisulfite | 10.00 g |
| Acetic acid | 10.20 g |
| Ammonium ferric ethylenediaminetetra acetate | 48.58 g |
| Ethylenediaminetetraacetic acid | 3.86 g |
| pH adjusted to 6.7 at 26.7 C | |

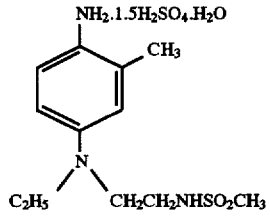

(Dev-1)

The spectra of the resulting dyes were measured and normalized to a maximum absorption of 1.00. The wavelength of maximum absorption was recorded as the "λmax." As a measure of the sharpness of the cut on the left (short wavelength) side of the absorption band the "left bandwidth" (LBW) was obtained by subtracting the wavelength at the point on the left side of the absorption band where the normalized density is 0.50 from the λmax. A lower value of LBW indicates a reduction in the unwanted green absorption. The λmax and LBW values are shown in Table 1.

TABLE 1

Couplers Dispersed in Solvent S-1 or S-2

| Comparison Invention | Coupler | Solvent | λmax | LBW |
|---|---|---|---|---|
| Comparison | C-1 | S-1 | 662 | 85 |
| Invention | I-1 | S-1 | 663 | 60 |
| Invention | I-2 | S-1 | 677 | 74 |
| Invention | I-4 | S-1 | 680 | 75 |
| Invention | I-1 | S-2 | 648 | 45 |
| Invention | I-2 | S-2 | 660 | 54 |
| Invention | I-3 | S-2 | 668 | 65 |
| Invention | I-4 | S-2 | 646 | 55 |
| Invention | I-5 | S-2 | 638 | 61 |

The data in Table 1 show that all of the cyan image couplers of the invention form image dyes that have absorption maxima in the range of about 640–680 nm and at the same time have spectra that are very sharp cutting on the short wavelength side of their absorption bands. These sharp-cutting absorption dye curves are indicated by the smaller values for the left bandwidth (LBW) than that of the dye from the comparison coupler. Thus the dyes formed from the couplers of the invention have less unwanted green absorption than the dyes formed from the comparison coupler, resulting in superior color reproduction and high color saturation. The data also show that while the desired hues were achieved with both solvents S-1 and S-2, the hues were more desirable when solvent S-2 was used.

What is claimed is:

1. A photographic element which comprises a light-sensitive silver halide emulsion layer having associated therewith a cyan dye-forming coupler having the formula:

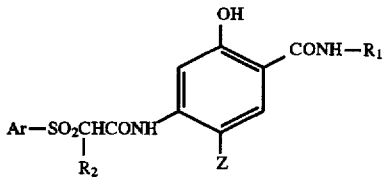

wherein:

$R_1$ represents an alkyl or aryl group;

$R_2$ represents an alkyl group of 2 to 4 carbon atoms;

Ar represents an aryl group; and

Z represents a hydrogen atom or a group capable of being split off by reaction of the coupler with an oxidized color developing agent.

2. The element of claim 1 wherein the coupler is dispersed in an aliphatic alcohol solvent.

3. The element of claim 2 wherein the solvent is oleyl alcohol.

4. The element of claim 1 wherein $R_1$ is an aryl group.

5. The element of claim 1 wherein $R_1$ is an alkyl group.

6. The element of claim 5 wherein $R_1$ is a perfluorinated alkyl group.

7. The element of claim 1 wherein $R_2$ is an ethyl group.

8. The element of claim 1 wherein $R_2$ is a propyl group.

9. The element of claim 1 wherein $R_2$ is a butyl group.

10. The element of claim 1 wherein Ar is a phenyl group.

11. The element of claim 1 wherein Ar is an alkylaryl group.

12. A multicolor photographic element comprising a reflective support bearing a blue-light sensitive silver halide emulsion layer containing a yellow dye-forming coupler, a green-light sensitive silver halide emulsion layer containing a magenta dye-forming coupler, and a red-light sensitive silver halide emulsion layer containing a cyan dye-forming coupler having the formula:

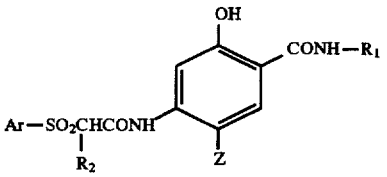

wherein:

$R_1$ represents an alkyl or aryl group;

$R_2$ represents an alkyl group of 2 to 4 carbon atoms;

Ar represents an aryl group; and

Z represents a hydrogen atom or a group capable of being split off by reaction of the coupler with an oxidized color developing agent.

13. A silver halide emulsion layer containing a coupler having the formula:

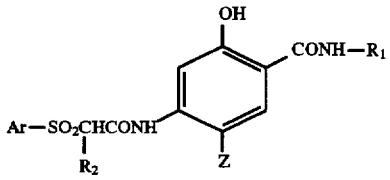

wherein:

$R_1$ represents an alkyl or aryl group;

$R_2$ represents an alkyl group of 2 to 4 carbon atoms:

Ar represents an aryl group; and

Z represents a hydrogen atom or a group capable of being split off by reaction of the coupler with an oxidized color developing agent.

14. A process for forming an image in the element of claim 1 after the element has been exposed to light comprising contacting the element with a color developing agent.

15. The process of claim 14 wherein the contact is for a period of 90 seconds or less.

16. The process of claim 15 wherein the contact is for a period of 60 seconds or less.

17. The process of claim 16 wherein the contact is for a period of 45 seconds or less.

* * * * *